US006963702B2

(12) United States Patent
Fletcher et al.

(10) Patent No.: US 6,963,702 B2
(45) Date of Patent: Nov. 8, 2005

(54) SYSTEMS AND METHODS FOR CURRENT DENSITY MONITOR AND CONTROL IN A COPY SUBSTRATE

(75) Inventors: Gerald M. Fletcher, Pittsford, NY (US); Christian O. Abreu, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 125 days.

(21) Appl. No.: 10/740,468

(22) Filed: Dec. 22, 2003

(65) Prior Publication Data

US 2005/0135826 A1 Jun. 23, 2005

(51) Int. Cl.[7] ..... G03G 15/16
(52) U.S. Cl. ..... 399/66; 399/81; 399/389
(58) Field of Search ..... 399/45, 66, 81, 399/313, 389

(56) References Cited

U.S. PATENT DOCUMENTS 5,953,556 A * 9/1999 Yamanaka ..... 399/66
6,456,804 B2 * 9/2002 Izawa et al. ..... 399/66

* cited by examiner

*Primary Examiner*—Hoang Ngo
(74) *Attorney, Agent, or Firm*—Oliff & Berridge, PLC

(57) ABSTRACT

Current density to copy substrates of varying widths if monitored and controlled in the electrostatic transfer unit of an electrostatic reproduction device. Current density through a copy substrate is appropriately adjusted to compensate for the presence of end leakage current effect to a receptor. Voltage supplied to a current generation unit in an electrostatic transfer unit is controlled independent of the characteristic properties of the copy substrate. Image reproduction quality is maintained in an electrostatic reproduction device even as the width of the copy substrate changes and in the presence of end leakage current effect.

19 Claims, 4 Drawing Sheets

SYSTEMS AND METHODS FOR CURRENT DENSITY MONITOR AND CONTROL IN A COPY SUBSTRATE

BACKGROUND OF THE INVENTION

1. Field of Invention

This invention is directed to systems and methods for monitoring and controlling current density delivered to a copy substrate by a transfer unit in electrostatic reproduction devices.

2. Description of Related Art

In a typical electrostatic reproduction process, reproduction is initiated by selectively charging and/or discharging a charge receptive imaging member (hereinafter "receptor"), e.g., a photoreceptor, in accordance with an original input document or an imaging signal, thereby generating an electrostatic latent image on the imaging member. This latent image is subsequently developed into a visible image by a process in which a charged developing material is deposited onto the surface of the latent image bearing imaging member. The charged particles in the developing material adhere to image areas of the latent image to form a visible developed image corresponding to the latent image on the imaging member. The developed image may be subsequently transferred, either directly or indirectly, from the imaging member to a copy substrate, such as, for example, paper or the like, to produce a "hard copy" output document.

Image transfer between the imaging member and the copy substrate is facilitated by passing the copy substrate through a transfer unit in the electrostatic printing device and imparting an electrostatic charge to the copy substrate. This electrostatic charge in the copy substrate allows for image transfer to, and image fixing, or "tacking" of the developing material on, the copy substrate. Specifically, the copy substrate is passed between a current generation unit, such as, for example, a voltage shield, and a receptor unit that faces the current generation unit. The receptor unit is bonded to a substrate, which generally forms a ground plane electrically grounding the receptor. Electrical current passing between the current generation unit and the grounded receptor unit electrostatically charges the copy substrate.

Electrostatic reproduction devices allow for different types of copy substrates, i.e., substrates of differing width and/or thickness and substrates having differing characteristic electrical resistivity. When the copy substrate is not as wide as the total width of the charge exposed area of the receptor, there are areas of the receptor that are exposed directly to the current generation unit without the protection of the resistivity associated with the copy substrate between the current generation unit and the grounded receptor. When a portion of the receptor is left exposed directly to the current generation unit, a phenomenon called "End Leakage Current Effect" results, whereby a highly positive voltage, and a resultantly high proportion of the total dynamic current produced in the transfer unit, can be found in the exposed portion of the receptor surface rather than in areas contacted by copy substrate. The extent of the end leakage current effect depends on, among other variables, the width of the copy substrate to which the image is being transferred.

Conventional electrostatic reproduction devices monitor, and control as constant, total dynamic current produced in the transfer unit. The current density in these devices, which is the current per unit length going to the copy substrate, is a function of many variables, which include width of the copy substrate and end leakage current effect. When copy substrate width changes, with total current kept constant, the current density to the copy substrate changes, i.e., drops when the copy substrate width decreases and rises when the copy substrate width increases.

It is advantageous to keep current density to the copy substrate constant. When electrostatic reproduction devices, however, control only total dynamic current between the current generation unit and the receptor, which is a sum of the current density delivered to the copy substrate and the current density going to regions beyond the copy substrate that for ease will be referred to as no-paper regions, current density to the copy substrate changes with changes in characteristics of the copy substrate. Conventional electrostatic reproduction devices control only average current density often by varying the voltage ($V_{shield}$) applied by the current generation unit opposite the receptor to maintain constant total dynamic current ($L_{dy}$). As width of the copy substrate changes, exposing more or less of the receptor directly to the total dynamic current for narrower and wider substrates respectively, the voltage is increased or decreased to keep the total dynamic current constant. A fundamental difficulty is that where the total dynamic current flows depends on whether there is a copy substrate, with certain characteristic resistivity, present over the receptor. The goal is to control the current density of the current applied to the copy substrate as this variable is ultimately related to the electrostatic forces trying to transfer toner and trying to electrostatically tack images to copy substrate surfaces.

To obtain the same charge density on the copy substrate as in the no-paper region, current applied to the copy substrate needs to be higher than current applied to the no-paper region because of resistivity of the copy substrate. The deposited charge is further removed from the ground plane of the receptor in the region covered by the copy substrate than it is in the no-paper region. Because the voltage potential difference is lower at the copy substrate, the current density is necessarily lower in the copy substrate region.

Conventional electrostatic reproduction devices begin operation by supplying a certain voltage. The total dynamic current is measured, and feedback is provided to adjust the voltage applied to maintain a preset total dynamic current between the current generation unit and the receptor. Total voltage required to produce a set dynamic current averaged across the regions of the receptor that are covered by copy substrate and the no-paper regions decreases as the width of the copy substrate decreases and exposes more no-paper region of the receptor. The voltage the system chooses if the width of the copy substrate is very narrow is much smaller than the voltage it chooses if the copy substrate is very wide with respect to the total width of the charge exposed area of the receptor, which is fixed. Therefore, the current density is much smaller when the copy substrate is narrow than it is when the copy substrate is wide.

There is certain latitude to the acceptable current density in a copy substrate based on the properties of the copy substrate relative to the transfer phenomenon. Latitude refers to an acceptable range of the electrostatic force applied to a copy substrate to facilitate pulling toner off the receptor and sufficient to electrostatically tack an image to the copy substrate. Latitude defines the limits that the electrostatic reproduction device needs to create regarding sufficient electrostatic field in a particular copy substrate to support the electrostatic reproduction process. With narrow copy substrate relative to the width of the charge exposed area of the receptor yielding a decrease in voltage to maintain total dynamic current, the system may not provide the current density through the copy substrate to meet the latitude required. The effective electrostatic transfer field between the copy substrate and the receptor decreases to an unacceptable level. Latitude in transfer systems depends on toner properties and a number of other variables. For instance, exceptional toner adhesion properties may yield wider latitude, allowing the device to accept significant decreases in the effective electrostatic force delivered to and through the copy substrate. There is, however, in all systems a threshold below which the current density of the current applied to the copy substrate will not support acceptable electrostatic image transfer. There is also conversely a threshold level above which the current density of the current applied to the copy substrate will begin to create unacceptable defects on the print such as those typically related to air breakdown effects. Latitude in the transfer system refers to current density conditions between these extremes. In general, when latitude is considered acceptable, it is understood that there may be some degradation in image quality under certain conditions, but such degradation is acceptable in the electrostatic reproduction device, e.g., not substantially noticeable to the naked eye.

Complex solutions to controlling current density in a copy substrate include segmenting a current generation unit of the electrostatic reproduction device. Current density is sensed and monitored through each of the individual discrete segments. Applied voltage is adjusted only to those segments that the sensing and monitoring functions determine are within the width of the copy substrate. The current density to the copy substrate, therefore, is maintained at constant value while the current to the areas of the receptor where there is no copy substrate is turned off. A disadvantage of this solution is that such a solution requires a special segmented voltage supply or current generation unit, which includes multiple connections to a power source and additional switching, both of which could be complex.

SUMMARY OF THE INVENTION

Electrostatic transfer fields drive transfer and tacking of images to copy substrates in a transfer unit of an electrostatic or xerographic reproduction device. The transfer fields are directly related to the dynamic current density (total dynamic current/unit width of the copy substrate) delivered to the copy substrate. Current density to the substrate is a variable which would be advantageous to monitor and control. Monitoring and/or controlling total dynamic current in a transfer unit does not determine and/or keep constant copy substrate current density as width of the copy substrate changes, particularly where an individual copy substrate width is less than the width of the transfer unit, due to end leakage current effect. The detrimental results of this end leakage current effect are particularly acute in systems in which a copy substrate is narrow relative to the width of the receptor in the transfer unit, and in which a copy substrate has high characteristic resistivity yielding narrow latitude in acceptable variations in current density to the copy substrate. When the current density to such copy substrates falls either below a certain lower threshold or rises above a certain upper threshold, the quality of the images produced by the electrostatic reproduction device decreases. It is desirable, therefore, to control dynamic current density delivered to the copy substrate within a given range rather than to control total dynamic current between the current generation unit and the receptor in order to account for end leakage current effect in systems where width of a copy substrate is variable.

In various exemplary embodiments, this invention provides systems and methods for monitoring and controlling current density delivered to a copy substrate by a transfer unit in an electrostatic reproduction device.

In various exemplary embodiments, this invention provides systems and methods for maintaining current density to a copy substrate at a constant level in the presence of end current leakage effect.

In various exemplary embodiments, this invention provides systems and methods for maintaining the current density of the copy substrate constant independent of the width of the copy substrate.

In various exemplary embodiments, this invention provides hardware and software solutions to maintain current densities to copy substrates at acceptable levels to support electrostatic imaging on the copy substrate within the allowable latitude of the particular copy substrate.

In various exemplary embodiments, this invention provides systems and methods for maintaining reproduction quality regardless of the adhesion characteristics or electrostatic conditions of the toner or toner/copy substrate combination.

These and other features and advantages of the disclosed embodiments are described in, or apparent from, the following detailed description of various exemplary embodiments of the systems and methods according to this invention.

BRIEF DESCRIPTION OF THE DRAWINGS

Various exemplary embodiments of the systems and methods according to this invention will be described, in detail, with reference to the accompanying figures, wherein.

DETAILED DESCRIPTION OF EXEMPLARY EMBODIMENTS

Figure 1:
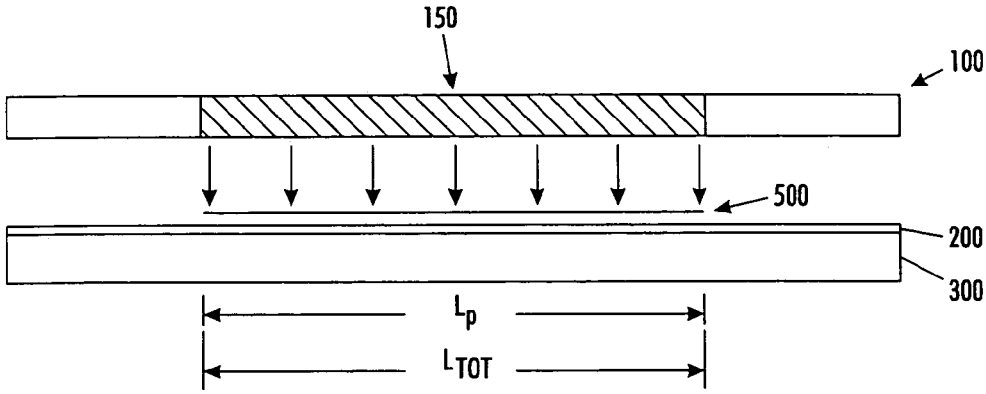
FIG. 1 illustrates a first exemplary embodiment of an electrostatic transfer unit according to this invention.

The following description of various exemplary embodiments of monitoring and control systems according to this invention may refer to and/or illustrate one specific type of transfer unit found in xerographic or electrostatic reproduction devices for the sake of clarity and familiarity. However, it should be appreciated that the principles of this invention, as outlined and/or discussed below, can equally be applied to any known or later-developed system that electrostatically energizes a copy substrate to support image reproduction, beyond the transfer units and/or xerographic and electrostatic reproduction devices specifically discussed herein.

Conventionally, a transfer unit may comprise, for example, a biased transfer roller consisting of at least one layer of rubber coating with a biased, conductive shaft. The biased transfer roller presses against a copy substrate and sufficiently high voltages applied to the roller shaft deliver current flow toward the copy substrate, a receptor and associated grounding substrate in response to the voltage applied.

Alternatively, the transfer unit could comprise one of a plurality of various types of corona charge generating devices. One example of such a device is typically referred to as a dicorotron which is a current generating unit comprising a small diameter dielectric coated conductive coronode wire and a conductive shield placed near the coronode. In operation, the coronode is energized by high AC potentials to create a source of positive and negative ions with no net DC current flow from the coronode due to the dielectric coating on the coronode. DC current flows between the dicorotron and the substrate through the receptor and the substrate to which in response to voltages applied between the shield. The transfer device could also be a more conventional type of corona device comprising a conductive wire or any array of conductive pins for the coronode, and with a conductive shield spaced near the coronode. In such case, high voltage is again applied to the coronode to create a source of ions for current flow in response to the coronode voltage. DC current can flow both toward the shield in the device and toward the grounded substrate. The DC shield current flow can be thought of as a kind of leakage current.

In order to only sense and control the current flow toward the copy substrate, such conventional devices electrically isolate the shield from ground and return the leakage current flow delivered to the shield back to the power supply so that the shield current is subtracted from the coronode current. If there are no other sources of leakage current in the system, this subtraction is the current flow, and it is controlled by the voltage applied to the coronode. In practice, all transfer devices have various sources of leakage current and similar to the return of shield current for conventional corona devices, these leakage currents must be returned to the power supply for subtraction such that only the new current outflow toward the copy substrate is obtained. As one example of such other source of leakage current, there can be a leakage current flow due to lateral current flow along a very high moisture content, low resitivity paper to conductive elements that contact the paper near the transfer zone. To maintain constant current flow only toward the copy substrate, conductive members that contact the copy substrate must be electrically isolated from ground and current delivered to them be returned to the power supply. More generally, these and all possible sources of leakage current are returned to the power supply and subtracted to measure and control the net outflow current through the grounded receptor. It should be appreciated that there are many other devices that can produce a net current flow through a receptor toward a grounding substrate in response to voltages applied to the device. In general, of prime importance is that the current generation unit creates a source of measurable new current flow from the transfer unit through the receptor toward ground plane that responds to the voltages applied to the current generation unit.

FIG. 1 illustrates a first exemplary embodiment of an electrostatic transfer unit according to this invention. As shown in FIG. 1, the transfer unit includes a current generation unit 100 and a receptor 200 mounted on a substrate 300 as a ground plane. Voltages applied to the current generator unit 100 create a source of net current flow through the receptor 200 to the grounding substrate 300. The current generation unit 100 has an active region of width 150 where current flows from the current generation unit 100 through the receptor 200 toward the grounding substrate 300.

In various exemplary embodiments of the systems and methods according to this invention, voltage applied to the current generation unit 100 creates a potential difference between the current generation unit 100 and the conductive ground plane 300 that creates a net DC flow which depends on that potential difference. Dynamic current (shown by the arrows in FIG. 1) flows from the active current generating region 150 of the transfer unit to the receptor 200, and grounding substrate 300. When a copy substrate 500 is introduced, with, for example, characteristic properties such as resistivity, thickness, and dielectric constant, and which, as shown in FIG. 1, approximates the width of the active current generating region 150 of the current generation unit 100, the voltage applied to the current generation unit 100 ($V_{shield}$) must be increased over that which would be required in the absence of a copy substrate, or in the presence of a narrower copy substrate, in order to maintain constant total dynamic current ($L_{dy}$) toward the grounding substrate 300.

In the various exemplary embodiments of the systems and methods according to this invention, current density in the copy substrate 500, when the width of the copy substrate 500 is approximately equal to the width of the active current generating region 150, equals the total dynamic current divided by the width of the copy substrate 500. Similarly, when the copy substrate 500 is completely removed, the current density to the bare receptor is equal to the total dynamic current divided by the length of the active current generating region 150. For any transfer unit, such as that depicted in FIG. 1, it should be appreciated that the voltage required for the current generation unit 100 to produce the same dynamic current is significantly greater when a copy substrate 500, with characteristic properties, is present than when such a copy substrate 500 is not present.

The electrostatic properties of receptors are not necessarily extremely stable such that these electrostatic properties remain constant over time or use. In general, there tends to be some level of drift even for the best receptors. Therefore, it is desirable to calibrate the system on a regular basis, such as, for example, at the start of a day, every few hours or even between individual reproduction tasks. The frequency of such calibration depends on the stability of the receptor properties which is determined for each receptor system. It should be appreciated that any calibration requirement is a function of each individual receptor and what is attacking that receptor at what frequency to cause wear on the receptor. The goal of calibration is to create, and/or update, stored data for current functioning of an individual receptor. The calibration can be either manual or automatic. The calibration is accomplished by varying one of two variables, total dynamic current or the voltage applied to the current generation 100, in a no-paper condition, and measuring the other variable as a function of the first to generate data to be stored for total dynamic current versus the voltage applied to the current generation unit 100 for the present current condition of the individual receptor. The operation yields a constant set of parameters for a function $f(V_{shield})$ that is stored for future use. The transfer unit now knows that in order to produce a given total dynamic current density to the receptor with no copy substrate present, based on the properties of the receptor, a certain voltage in the current generation unit 100 is required.

Figure 2:
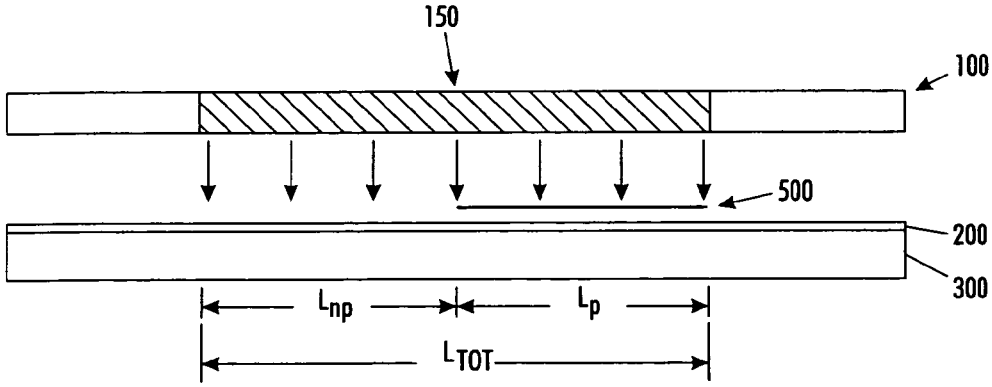
FIG. 2 illustrates a second exemplary embodiment of an electrostatic transfer unit according to this invention.

FIG. 2 illustrates a second exemplary embodiment of an electrostatic transfer unit according to this invention. As shown in FIG. 2, the transfer unit, which includes the current generation unit 100, and the receptor 200 bonded to a grounding substrate 300, remains unchanged. The difference is that the copy substrate 500 only covers a portion of the receptor 200 and more importantly only a portion of the active current generation region 150. The total width of the active current generating region 150 is, therefore, subdivided into two portions: a portion covered by a copy substrate, ($L_p$); and a portion not covered by a copy substrate but rather exposed directly to the current generation unit 100, ($L_{np}$).

In various exemplary embodiments of the systems and methods according to this invention, when the active current generating region 150 of the receptor 200 is only partially covered by a copy substrate 500, the relationship between total dynamic current and current density to the copy substrate 500, this latter value that is sought to be monitored and controlled in this invention, is more complex. This relationship is expressed in the following equation:

$$I_{dy} = \left(\frac{i}{L}\right)_p \times L_p + \left(\frac{i}{L}\right)_{np} \times L_{np}$$

where:

$I_{dy}$ is total dynamic current;

$(i/L)_p$ is the current density in the portion of the active current generating region of the receptor covered by the copy substrate, and therefore, the current density to the copy substrate;

$L_p$ is the width of the copy substrate, or that portion of the active current generating region of the receptor covered by the copy substrate;

$(i/L)_{np}$ is the current density to the portion of the active current generating region of the receptor exposed directly to the current generation unit, i.e., the no-paper region; and $L_{np}$ is the width of the portion of the receptor that is exposed directly to the current generation unit, i.e., the total width of the no-paper region that is within the width of the active charge generating region of the current generation unit.

As noted above, for a given receptor at a given time, the variable $(i/L)_{np}$ is represented by the function, $f(V_{shield})$, initially preset, or in operation collected and stored as part of the system calibration.

In conventional systems, the voltage that the transfer unit chooses to apply to the current generation unit is an averaging between satisfying the total current requirement between the no-paper region of the active current generating region 150 of the receptor and that portion covered by the copy substrate. When the copy substrate is completely covering the active current generating region 150 of the receptor, as in FIG. 1, the current sensed is the total current delivered to the copy substrate. In such a case, total current density of the copy substrate would be controlled in the conventional system. There is no no-paper region. All of the current being controlled is actually current delivered to the copy substrate that is of interest. Therefore, the device is directly controlling the current density of the copy substrate independent, for example, of variable resistivity or thickness properties of the sheets of copy substrate moving below the device. By contrast, where there are a mix of copy substrate and no-paper regions of the active current generating region 150 of the receptor, average current density between the separate regions of the receptor is controlled with the control of total dynamic current. In the extreme, where the copy substrate is of negligible width, particularly in comparison to the overall width of the active current generating region 150 of the receptor, as far as the current generation unit and system are concerned, the voltage required is the voltage that would be applicable to the no-paper region, a much lower voltage than that needed in the case where the copy substrate is totally covering the active current generating region 150 of the receptor.

In various exemplary embodiments, the systems and methods according to this invention monitor and control current density to the copy substrate by implementing the function represented by the following equation (hereinafter "Equation 1"):

$$\left(\frac{i}{L}\right)_p = \frac{I_{dy} - f(V_{shield}) \times (L_{tot} - L_p)}{L_p}$$

where all of the variables remain as defined above and $L_{tot}$ is the total width of the active charge generating region 150 of the current generation unit 100. Current density of the copy substrate is a function of the width of the copy substrate ($L_p$) as a portion of the total width of the active charge generating region 150 of the current generation unit 100, ($L_{tot}$).

Figure 3:
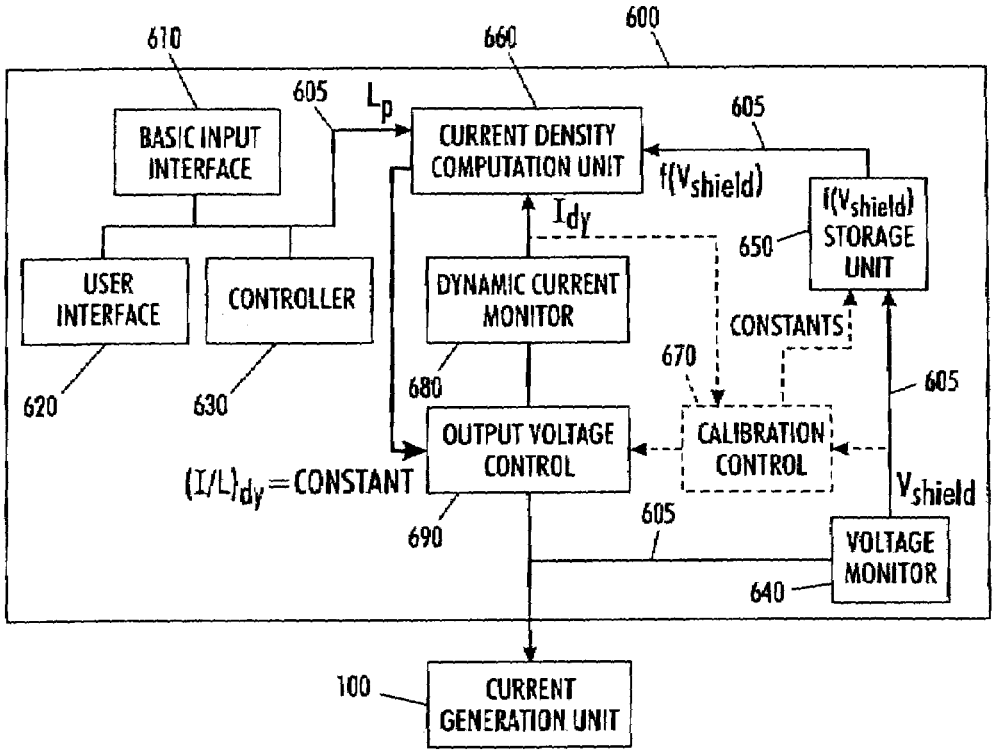
FIG. 3 is a functional block diagram of an exemplary embodiment of a current density monitor and control unit according to this invention.

FIG. 3 is a functional block diagram of an exemplary embodiment of a current density monitor and control unit 600 according to this invention. As shown in FIG. 3, the current density monitor and control unit 600 includes: a basic input interface 610; a user interface 620; a controller 630; a dynamic voltage monitor unit 640 for determining the output voltage supplied to the current generation unit; a storage unit 650, for data representing $f(V_{shield})$, which accepts information from the voltage monitor unit 640; a copy substrate current density computation unit 660; a calibration control unit 670; a dynamic current monitor unit 680; and a voltage control unit 690 for controlling voltage delivered to the current generation unit 100, all connected by a data/control bus 605.

In various exemplary embodiments of the systems and methods according to this invention, through the basic input interface 610, the current density monitor and control unit 600 can recover information regarding the width of the copy substrate manually, such as, for example, through user input in the user interface 620, or automatically through sensors in the copy substrate handling path. The dynamic current monitor unit 680 obtains values for total dynamic current and provides this information to the current density computation module 660.

The voltage function storage unit 650 holds the constants related to the function $f(V_{shield})$, often initially preset for the receptor, and/or determined for the present condition of the receptor in an optional calibration step. This storage unit also accepts information from the dynamic voltage monitor unit 640 to create the dynamic function $f(V_{shield})$, and it provides this function to the current density computation module 660. The current density computation unit 660 then uses this information to determine, and maintain constant, the current density to the paper $(i/L)_p$ by forming the equation described in Equation 1. The current density computation unit 660 is provided with the fixed value $L_{tot}$ related to the width of the active charge generating region 150 of the current generation unit 100, and is provided with the width of the copy substrate $L_p$ from the basic input interface 610. Given the current density $(i/L)_p$ which the system seeks to maintain toward the copy substrate to achieve good transfer performance independent of the copy width $L_p$, the current density computation unit 660 receives the signal from the voltage function storage unit 650 and automatically subtracts this from the dynamically measured function $I_{dy}$ ($V_{shield}$) signal provided by the current monitor unit 680, and it forms the appropriate multiplications and divisions of the width parameters according to Equation 1 to obtain a signal that is directly related to $(i/L)_p$. The current density computation unit 660 uses feedback to the output voltage control unit 690 to automatically adjust the output voltage $V_{shield}$ to maintain $(i/L)_p$ constant.

It should be appreciated that although depicted in FIG. 3 as separate units, the output voltage control unit 690, the current density computation unit 660, the dynamic current monitor 680, and the dynamic voltage monitor unit 640 can all be contained in a single unit within the current density monitor and control unit 600. It is the output voltage control unit 670 that in turn controls the voltage supplied to the current generation unit 100 to maintain the $(i/L)_p$ level constant for any copy substrate width $L_p$.

In various exemplary embodiments of the systems and methods according to this invention, the current density monitor and control unit 600 also includes a calibration control unit 670 in order to monitor and control a calibration step accomplished with no copy substrate present to determine the values of the constants of the function $f(V_{shield})$ for the receptor in its present state. The voltage applied to the current generation unit 100 is varied across a range of values and total dynamic current is measured, or alternatively total dynamic current is varied and the voltage applied to the current generation unit 100 is measured. Data is generated of the voltage $V_{shield}$ applied versus total dynamic current and this data is provided for storage in the voltage function storage unit 650 of the current density monitor and control unit 600. The data is used to automatically calculate constant parameters for the function $f(V_{shield})$. The function may be set or measured as a simple linear equation $I_{dy}$ vs $V_{shield}$, such that only two constants need be determined.

Once the constant parameters of the function $f(V_{shield})$ are stored, all of the information required to monitor and control current density is available. Using information supplied by the voltage monitor module 640, the dynamic function $f(V_{shield})$ signal is automatically created in the voltage function storage unit 650 and provided to the current density computation module 660. Total dynamic current ($I_{dy}$) is available through the $L_{dy}$ monitor 680, and total width of the receptor ($L_{tot}$) is a constant. Width of the copy substrate ($L_p$) is supplied either manually or automatically through the basic input interface 610. It should be appreciated that typically electrostatic reproduction devices need to know the width of the copy substrate, such as, for example, paper, for internal copy substrate handling reasons. This value may be manually input through the user interface 620, or there may be a sensing device, such as, for example, a stop position on a feed tray and an associated sensor to determine that the paper stop is in a certain position. More sophisticated machines have more sophisticated sensors to sense copy substrate width in the handling path. Given this information, the current density computation module 660 automatically creates the Equation 1 solution and feeds the resultant calculation back to the output voltage control unit 690 to maintain the quantity $(i/L)_p$ constant by automatic adjustment of the output voltage.

In various exemplary embodiments of the systems and methods according to this invention, the output voltage control unit 690 includes a control circuit that controls current density to the copy substrate by controlling voltage to the current generation unit 100 and substantially ignoring current density to the no-paper regions of the receptor. The voltage control unit 690 includes feedback control to choose the value of the output voltage to maintain the current density in accordance with Equation 1.

In various exemplary embodiments, the systems and methods according to this invention provide a circuit to create that voltage value based on the other functional inputs, and feedback to a power supply to adjust the voltage to maintain current density value to the copy substrate constant. For a given width of copy substrate, the voltage is adjustable such that the resultant current density to the copy substrate is held constant.

In various exemplary embodiments of the systems and methods according to this invention, an optional timing device, unit or circuit (not shown) is includable in the current density monitor and control unit 600 to drive the current generated by the current generation unit 100 to a preset and/or constant value in the inter-document regions of a given reproduction task. Such a timing device, unit or circuit, if included, is usable to limit system-controlled current fluctuations in the current generation unit 100 as the current density monitor and control unit 600 attempts to respond to those periods when receptor is intermittently exposed to the full width of the active current generating region (depicted in FIG. 1 as 150) of the current generation unit 100 in the absence of copy substrate, such as, for example, between individual sheets of copy substrate as such sheets pass sequentially between the active current generating region of the current generation unit 100 and the receptor during the given reproduction task.

In various exemplary embodiments of the systems and methods according to this invention, the value input for the width of the copy substrate for a given reproduction task is not a value that routinely changes. In general, this value is adjusted for a specific reproduction task. Provision exists, however, for interleaving different widths of copy substrates in a single reproduction task, in that the monitor and control circuit 600 could automatically respond in phase with different widths of copy substrate presented to the transfer unit, as long as there is varying input for $L_p$ as different widths of copy substrates are introduced. In such case, the control circuits would have to respond fast enough to adjust voltage to the current generation unit 100 for varying copy substrates in order to maintain constant current density across varying widths of copy substrates.

It should be appreciated that, given the required inputs, software algorithms, hardware circuits, or any combination of software and hardware control elements can be used to implement the monitor and control tasks. Any of the data storage units depicted in FIG. 3 can be implemented using any appropriate combination of alterable, volatile or non-volatile memory, or non-alterable, or fixed, memory. The alterable memory, whether volatile or non-volatile, can be implemented using any one or more of static or dynamic RAM, a floppy disk and disk drive, a writable or re-rewritable optical disk and disk drive, a hard drive, flash memory, or any like medium or device. Similarly, the non-alterable or fixed memory can be implemented using any one or more of ROM, PROM, EPROM, EEPROM, an optical ROM disk, such as a CD-ROM or DVD-ROM disk, and disk drive, or any like medium or device.

Figure 4:
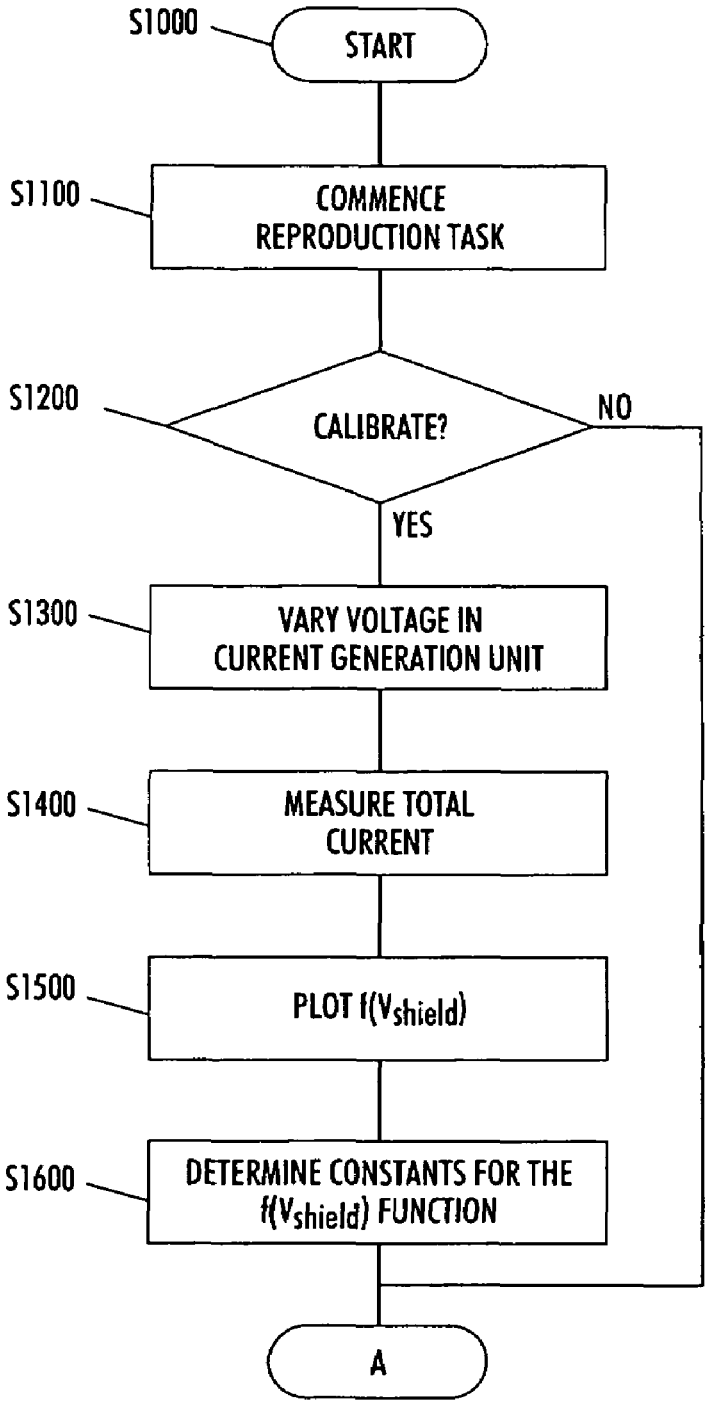
FIGS. 4 and 5 are flowcharts outlining one exemplary embodiment of a method for monitoring and controlling current density in a copy substrate according to this invention.
Figure 5:
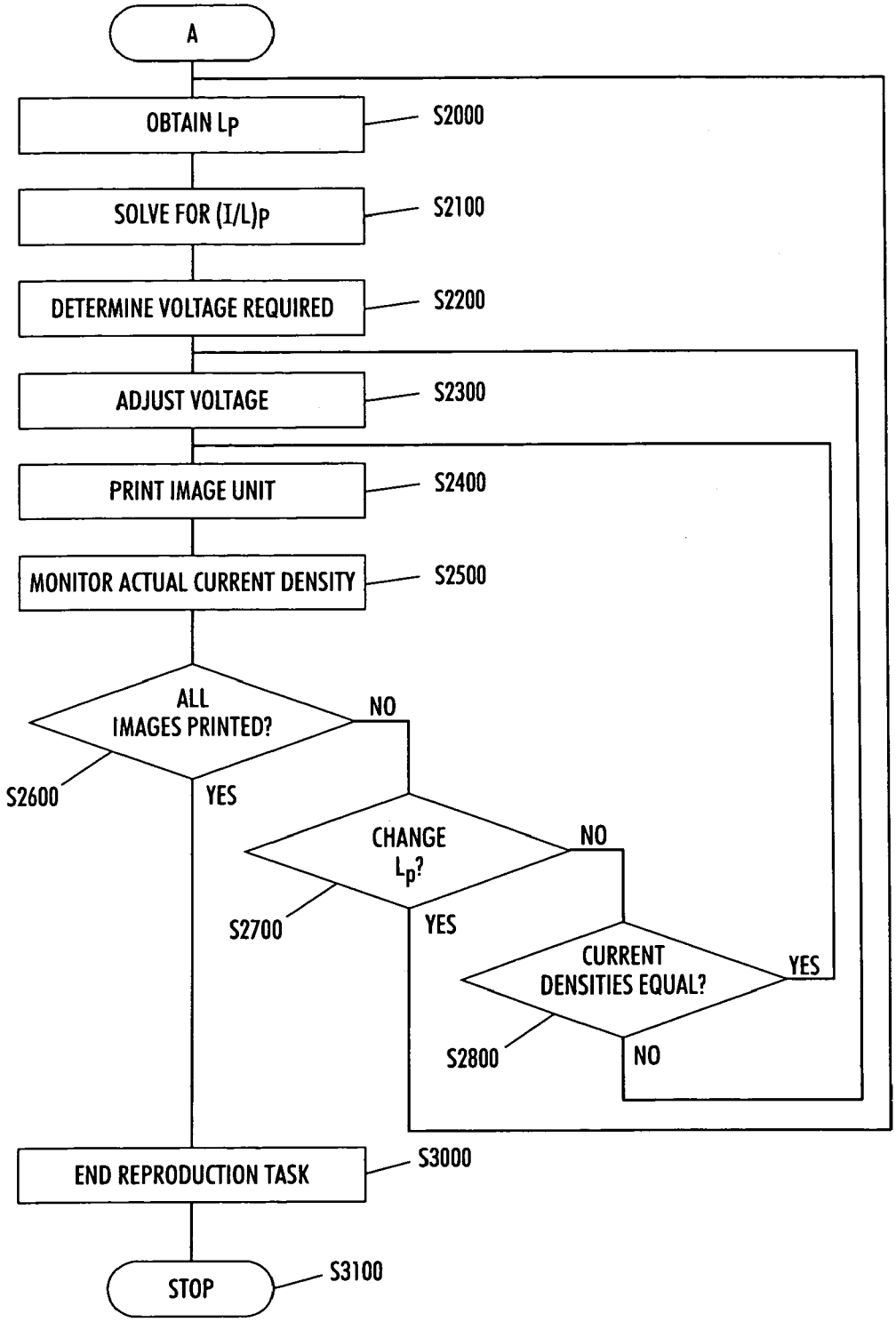

FIGS. 4 and 5 are flowcharts outlining one exemplary embodiment of a method for monitoring and controlling current density in a copy substrate according to this invention.

As shown in FIG. 4, operation begins at step S1000 and continues to step S1100, where a reproduction operation is commenced. The operation then continues to step S1200.

In step S1200, a determination is made whether the system is to be calibrated. In various exemplary embodiments of the systems and methods according to this invention, a calibration step is scheduled at routine intervals based on factors that include elapsed time, or types and durations of use of an exemplary transfer unit in an exemplary electrostatic reproduction device. If the determination made in step S1200 is that calibration is not required, the calibration steps are bypassed and the operation proceeds directly to step S2000.

If the determination is made at step S1200 that calibration is required, the operation proceeds to step S1300.

In step S1300, with no copy substrate present, the voltage applied to the current generation unit is varied across a range of typical values. The operation continues to step S1400.

In step 1400, for varying values of voltage in the current generation unit, values for total dynamic current through the receptor are measured and recorded. It should be appreciate that total dynamic current could be the control variable and the voltage applied to the current generation unit the measured and recorded variable. The operation continues to step S1500.

In step S1500, the system records as a function $f(V_{shield})$ the values of voltage from the current generation unit versus total dynamic current through the receptor. The operation continues to step S1600.

In step S1600, constants gathered and recorded in steps S1300 through S1500 are stored for later use. The operation continues to step S2000, depicted in FIG. 5.

In step S2000, the width ($L_p$) of the copy substrate presented to the transfer unit is obtained. In various exemplary embodiments, the value for the width of a copy substrate may be either manually input by an operator, or automatically obtained from information available from static or dynamic sensors in the copy substrate handling paths of the exemplary electrostatic reproduction device. The operation continues to step S2100.

In step S2100, the current density across the copy substrate is obtained according to the following equation, Equation 1:

$$\left(\frac{i}{L}\right)_p = \frac{I_{dy} - f(V_{shield}) \times (L_{tot} - L_p)}{L_p}$$

The operation then continues to step S2200.

In step S2200, the voltage required to maintain the current density obtained in step S2100 is obtained from the storage unit which stores the data for shield the voltage applied to the current generation unit versus total dynamic current. The operation continues to step S2300.

In step S2300, the voltage in the current generation unit is adjusted to the level obtained from the stored data. The operation continues to step S2400.

In step S2400, a single unit of copy substrate is passed through the transfer unit and an image is recorded on the single unit of copy substrate. The operation continues to step S2500.

In step S2500, while the copy substrate is passing through the transfer unit and the image is being recorded thereon, actual current density through the copy substrate is monitored for comparison with the input current density as determined in step S2100, as described below in conjunction with step S2800. The operation continues to step S2600.

In step S2600, a determination is made whether all pages of the image have been printed. If so, the operation continues to step S3000.

If a determination is made in step S2600 that all of the pages required have not been printed, the operation continues to step S2700.

In step S2700, a determination is made whether there is a requirement between units of copy substrate to change the input regarding width of the copy substrate to the transfer unit. If, in step S2700, a determination is made that the value for the width of the copy substrate does not need to be changed the operation continues to step S2800.

If, in step S2700, a determination is made that the value for the width of the copy substrate needs to be changed for the subsequent units of copy substrate, the operation reverts to step S2000.

In step S2800, a determination is made whether the actual measured current density is equal to the input current density as determined in step S2100. If the actual measured current density is equal to the input current density, the operation reverts to step S2400.

If the determination made in step S2800 is that the actual measured current density is different from the input current density as obtained in step S2100, the operation reverts to step S2300 and an adjustment of voltage in the current generation unit is accomplished.

In step S3000 with all image reproduction for this individual task in the exemplary electrostatic reproduction device complete, the reproduction operation ends. The operation continues to step S3100 where the operation stops.

While this invention has been described in conjunction with the exemplary embodiments outlined above, various alternatives, modifications, variations and/or improvements may be possible within the spirit and scope of the invention. Accordingly, the exemplary embodiments of the invention as set forth above are intended to be illustrative, not limiting. Various changes may be made without departing from the spirit and the invention.

What is claimed is:

1. A current density monitor and control system, comprising:

an electrostatic device that imparts an electrostatic field to a copy substrate, the electrostatic device comprising a current generation unit and a receptor opposite the current generation unit;

a current monitoring unit that monitors total dynamic current flowing from the current generation unit to the receptor;

an input unit that inputs the width of a copy substrate;

a storage unit that stores the constant parameters of the function of voltage applied to the current generation unit versus total dynamic current for the receptor;

a controller that determines voltage required to maintain a predetermined charge density in the copy substrate; and a voltage control unit that adjusts the voltage of the current generation unit to the value determined by the controller.

2. The current density monitor and control system of claim 1, further comprising a feedback unit that measures actual current across the copy substrate and provides feedback as required to control the voltage of the current generation unit to maintain actual current density in the copy substrate substantially equal to desired current density in the copy substrate.

3. The current density monitor and control system of claim 1, further comprising a calibration unit that calculates and updates the function of voltage applied to the current generation unit versus total dynamic current for the receptor.

4. The current density monitor and control system of claim 3, wherein the calibration unit comprises:

a voltage input unit that progressively varies the voltage in the current generation unit through a predetermined range of values;

a monitor unit that measures total dynamic current to the receptor for discrete voltage values; and a recording unit that records values for total dynamic current versus voltage applied to the current generation unit by overwriting the function of voltage applied to the current generation unit versus total dynamic current in the storage unit.

5. The current density monitor and control system of claim 1, wherein the input unit that inputs the width of a copy substrate is a manual input unit requiring operator interface.

6. The current density monitor and control system of claim 1, wherein the input unit that inputs the width of a copy substrate is an automatic unit which receives input regarding the width of the copy substrate from sensors in the copy substrate handling path.

7. The current density monitor and control system of claim 1, wherein the input unit, controller and voltage control unit respond quickly enough to modify the voltage applied to the current generation unit in response to a plurality of copy substrate widths presented in a single reproduction task.

8. An electrostatic image-producing device including the current density monitor and control system of claim 1.

9. A xerographic reproduction device including the current density monitor and control system of claim 1.

10. A digital photocopier including the current density monitor and control system of claim 1.

11. A method for current density monitor and control in a copy substrate of an electrostatic device, comprising:

inputting information indicating the width of the copy substrate;

determining the voltage required to maintain a desired current density through the copy substrate and a receptor; and applying the determined voltage to the current generation unit to induce current across the copy substrate and receptor.

12. The method of claim 11, wherein determining the voltage required comprises accessing stored data for total dynamic current versus voltage applied to a current generation unit in order to obtain the voltage required to maintain a desired current density through the copy substrate.

13. The method of claim 11, further comprising a calibration function comprising:

varying the voltage applied to the current generation unit across a predetermined range of values with no copy substrate present;

measuring the total dynamic current to the receptor for discrete voltage values; and recording or updating stored data for total dynamic current versus voltage applied to a current generation unit.

14. The method of claim 11, further comprising:

measuring the actual current through the copy substrate; and providing feedback to adjust the voltage applied to the current generation unit to maintain the desired current density through the copy substrate.

15. The method of claim 11, further comprising:

changing the width of the copy substrate between any consecutive unit of copy substrate in a single image reproduction task;

determining the voltage applied to the current generation unit required to maintain the desired current density through the varied width of copy substrate; and applying the determined voltage to the current generation unit.

16. The method of claim 15, wherein changing the width of the copy substrate, determining the voltage required, and applying determined voltage to the current generation unit occurs between each new copy substrate.

17. The method of claim 11, wherein inputting information indicating the width of the copy substrate requires a manual input.

18. The method of claim 11, wherein inputting information indicating the width of the copy substrate occurs automatically from sensors in the copy substrate-handling path.

19. A storage medium on which is recorded a program for implementing the method of claim 11.

* * * * *